US011809106B2

(12) United States Patent
Kato et al.

(10) Patent No.: US 11,809,106 B2
(45) Date of Patent: Nov. 7, 2023

(54) IMAGE FORMING APPARATUS

(71) Applicant: BROTHER KOGYO KABUSHIKI KAISHA, Nagoya (JP)

(72) Inventors: Sadaharu Kato, Kariya (JP); Shuhei Fukue, Nagoya (JP); Hirotaka Imaeda, Nagoya (JP); Shunsuke Ueki, Nagoya (JP); Yusuke Mizuno, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/807,023

(22) Filed: Jun. 15, 2022

(65) Prior Publication Data

US 2022/0404745 A1 Dec. 22, 2022

(30) Foreign Application Priority Data

Jun. 17, 2021 (JP) ..... 2021-100650

(51) Int. Cl.
*G03G 15/20* (2006.01)

(52) U.S. Cl.
CPC ..... *G03G 15/2039* (2013.01); *G03G 15/2017* (2013.01); *G03G 15/2064* (2013.01)

(58) Field of Classification Search
CPC ..... G03G 15/2039; G03G 15/2017; G03G 15/2064
See application file for complete search history.

(56) References Cited

U.S. PATENT DOCUMENTS

2010/0322667 A1* 12/2010 Kitagawa ..... G03G 15/2035 399/329
2019/0235423 A1 8/2019 Kato
2021/0191295 A1 6/2021 Tajiri et al.

FOREIGN PATENT DOCUMENTS

JP 2005189773 A 7/2005
JP 2019132998 A 8/2019
JP 2021099441 A 7/2021

* cited by examiner

*Primary Examiner* — Stephanie E Bloss
*Assistant Examiner* — Michael A Harrison
(74) *Attorney, Agent, or Firm* — Scully, Scott, Murphy & Presser, P.C.

(57) ABSTRACT

In an image forming apparatus, a controller causes a first fixing member to heat up to a standby temperature Tr lower than a fixing temperature, through a control process executed from a state in which rotation of the first fixing member is stopped and a nip pressure is set at a second pressure smaller than a first pressure. The control process includes: a first process of activating and controlling a heater to cause the first fixing member to heat up toward a target temperature; a second process of starting the rotation of the first fixing member; a third process of changing the nip pressure from the second pressure to the first pressure; a fourth process of changing the nip pressure from the first pressure to the second pressure; and a fifth process of stopping the rotation of the first fixing member, executed in this sequence.

20 Claims, 10 Drawing Sheets

IMAGE FORMING APPARATUS

REFERENCE TO RELATED APPLICATIONS

This application claims priority from Japanese Patent Application No. 2021-100650 filed on Jun. 17, 2021, the disclosure of which is incorporated herein by reference in its entirety.

BACKGROUND ART

An image forming apparatus having a fixing device for fixing a developer image on a sheet is known in the art.

In such an image forming apparatus, the fixing device may include two fixing members (e.g., a heating roller and a pressure roller), and a mechanism for switching between a state in which the fixing members are pressed against each other and a state in which the fixing members are located apart from each other. In operation, for example, when a warm-up process is executed, a heater is turned on with the pressure roller (one of the two fixing members) being positioned apart from the heating roller (the other fixing member), and once the heating roller heats up to a predetermined temperature, the heating roller is caused to rotate and brought into contact with and pressed against the heating roller.

One of the fixing members of the fixing device may be configured to include a belt, instead of a roller, as a member to form a nip in combination with the other of the fixing members which may be configured to include a roller.

DESCRIPTION

When a warm-up process is executed in the fixing device with a first fixing member including a roller and a second fixing member including a belt, the belt may preferably be brought into contact with the roller with a nip pressure smaller than a nip pressure to be applied during a printing process before the roller is caused to start rotating so as to mitigate damage to the belt. However, contact with such a smaller nip pressure would possibly fail to make the second fixing member sufficiently hot by a time when the first fixing member is caused to heat up to a standby temperature.

It would be desirable to provide an image forming apparatus with a fixing device using a belt, in which damage to the belt can be mitigated and a fixing member including the belt can be made sufficiently hot.

In one aspect, an image forming apparatus comprising a first fixing member including a roller, a second fixing member including a belt, a heater, a pressure control mechanism, and a controller is disclosed. The second fixing member or the belt is configured to form a nip in combination with the first fixing member. The heater is configured to heat the first fixing member. The pressure control mechanism is configured to be capable of changing a nip pressure exerted at the nip formed between the first fixing member and the second fixing member, to a first nip pressure and to a second nip pressure smaller than the first nip pressure. The controller is configured to cause the first fixing member to heat up to a standby temperature lower than a fixing temperature, through a control process. The control process is executed from a state in which rotation of the first fixing member is stopped and the nip pressure is set at the second nip pressure. The control process comprises: a first process of activating and controlling the heater to cause the first fixing member to heat up toward a target temperature; a second process of starting the rotation of the first fixing member; a third process of changing the nip pressure from the second nip pressure to the first nip pressure; a fourth process of changing the nip pressure from the first nip pressure to the second nip pressure; and a fifth process of stopping the rotation of the first fixing member. The first, second, third, fourth and fifth processes are executed in this sequence.

The above and other aspects, their advantages and further features will become more apparent by describing in detail illustrative, non-limiting embodiments thereof with reference to the accompanying drawings.

FIG. 9 is a time chart showing one example of operations carried out when an initial temperature is lower than a third predetermined temperature To.

FIG. 10 is a time chart showing one example of operations carried out when the initial temperature is equal to or higher than the third predetermined temperature To.

Figure 1:
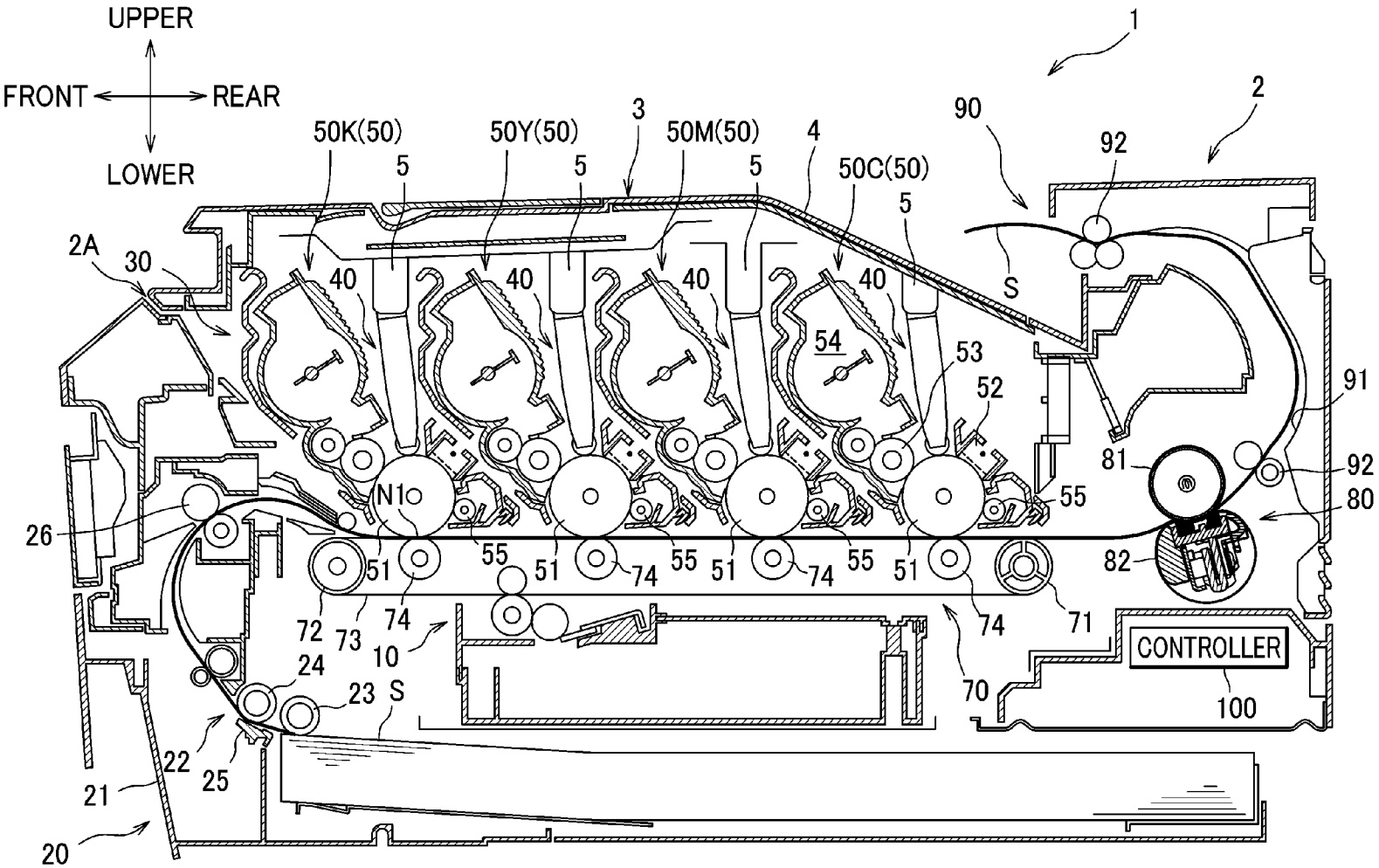
FIG. 1 is a section view of a color printer.

As shown in FIG. 1, a color printer 1 as an example of an image forming apparatus comprises a housing 2, and several components housed within the housing 2, which include a sheet feeder unit 20, an image forming unit 30, a fixing device 80, a sheet ejection unit 90, and a controller 100. The sheet feeder unit 20 feeds a sheet S to the image forming unit 30. The image forming unit 30 forms a toner image on the sheet S. The fixing device 80 fixes the toner image on the sheet S. The sheet ejection unit 90 ejects the sheet on which an image is formed.

The housing 2 has an opening 2A formed on its upper part. The opening 2A is opened and closed by an upper cover 3 which is rotatably supported by the housing 2. The upper cover 3 has an upper surface configured as an output tray 4 on which sheets S ejected from the housing 2 are to be stacked, and a lower surface provided with a plurality of LED attachment members 5 which hold their respective LED units 40.

The sheet feeder unit 20 is provided in a lower space inside the housing 2, and comprises a sheet feed tray 21 removably installed in the housing 2, and a sheet feed mechanism 22 configured to feed a sheet S from the sheet feed tray 21 to the image forming unit 30. The sheet feed mechanism 22 comprises a pickup roller 23, a separation roller 24, a separation pad 25, and a registration roller 26.

In the sheet feeder unit 20, sheets S in the sheet feed tray 21 are fed by the pickup roller 23. Then, the sheets S are separated one from the others by the separation roller 24 and the separation pad 25. Thereafter, the registration roller 26 aligns the position of the front edge of the sheet S, and conveys the sheet S toward the image forming unit 30. To be more specific, the registration roller 26 stops rotating when it contacts a sheet S fed by the separation roller 24 to align the position of the front edge of the sheet S, and then starts rotating to feed the sheet S.

The image forming unit 30 comprises four LED units 40, four process cartridges 50, a transfer unit 70, and a belt cleaner 10.

Each of the LED units 40 is swingably coupled to the corresponding LED attachment member 5, and appropriately positioned in place and supported by a locating member provided in the housing 2.

The process cartridges 50 are located between the upper cover 3 and the sheet feeder unit 20 and arranged in a front-rear direction. Each of the process cartridges 50 comprises a photoconductor drum 51 as an example of a photoconductor, a charger 52, a development roller 53, a toner storage chamber 54 for storing toner as an example of developer, a cleaning roller 55, and other parts.

The process cartridges 50 include four process cartridges with toner of black, yellow, magenta and cyan colors contained therein respectively as designated by reference characters 50K, 50Y, 50M and 50C, which are arranged in this sequence in a direction of conveyance of a sheet S.

The photoconductor drum 51 is a member capable of carrying toner. To be more specific, the surface of the photoconductor drum 51 is partially exposed to light by the LED unit 40, and exposed areas of the surface serves to carry toner. The photoconductor drum 51 is provided in each of the plurality of process cartridges 50. The photoconductor drums 51 are arranged along a path of conveyance of a sheet S.

The development roller 53 is a roller that carries toner. The development roller 53 is arranged to contact the photoconductor drum 51 to supply toner to an electrostatic latent image on the photoconductor drum 51.

The development roller 53 is provided in such a manner as to be caused to move near to and apart from the corresponding photoconductor drum 51 by a switching mechanism (not shown) under control of the controller 100.

The cleaning roller 55 is a member capable of collecting toner on the photoconductor drum 51. One cleaning roller 55 is provided for each photoconductor drum 51. Each cleaning roller 55 is located adjacent to the corresponding photoconductor drum 51.

The transfer unit 70 is provided between the sheet feeder unit 20 and a set of the process cartridges 50, and comprises a drive roller 71, a follower roller 72, a conveyor belt 73, and transfer rollers 74.

The drive roller 71 and the follower roller 72 are located apart from each other in the front-rear direction with their axes of rotation oriented parallel to each other in a direction perpendicular to the front-rear direction. The conveyor belt 73 is an endless belt stretched between and looped around the drive roller 71 and the follower roller 72. The conveyor belt 73 is a member for conveying a sheet S. The outside surface of the conveyor belt 73 is in contact with each of the photoconductor drums 51. Four transfer rollers 74 are located inside the conveyor belt 73 in positions corresponding to the photoconductor drums 51.

The conveyor belt 73 is nipped between each of the transfer rollers 74 and the corresponding photoconductor drum 51. A sheet S is conveyed by the conveyor belt 73 and the photoconductor drum 51.

The belt cleaner 10 is located under the conveyor belt 73 in contact with the outside surface of the conveyor belt 73. When the conveyor belt 73 slides on the belt cleaner 10, the belt cleaner 10 collects toner or other objects adhered on the conveyor belt 73.

The fixing device 80 comprises a first fixing member 81 and a second fixing member 82. Structural features of the fixing device 80 will be described later in detail.

In the image forming unit 30 configured as described above, the surfaces of the photoconductor drums 51 are uniformly charged by the chargers 52, and then exposed to light by the LED units 40. As a result, an electrostatic latent image formulated based on image data is formed on each photoconductor drum 51. Thereafter, the electrostatic latent image is supplied with toner by the corresponding development roller 53, so that a toner image is carried on the photoconductor drum 51.

While a sheet S fed onto the conveyor belt 73 passes through between each photoconductor drum 51 and the corresponding transfer roller 74 located inside the conveyor belt 73, the toner image formed on the photoconductor drum 51 is transferred on the sheet S. While the sheet S on which toner images for respective colors have been transferred from the photoconductor drums 51 passes through between the first fixing member 81 and the second fixing member 82, the toner images are thermally fixed on the sheet S.

The sheet ejection unit 90 comprises a sheet-ejecting conveyor path 91 and a plurality of conveyor rollers 92. The sheet S on which toner images have been thermally fixed is conveyed by the conveyor rollers 92 through the sheet-ejecting conveyor path 91, and ejected to the outside of the housing 2, and stacked on the output tray 4.

Figure 2:
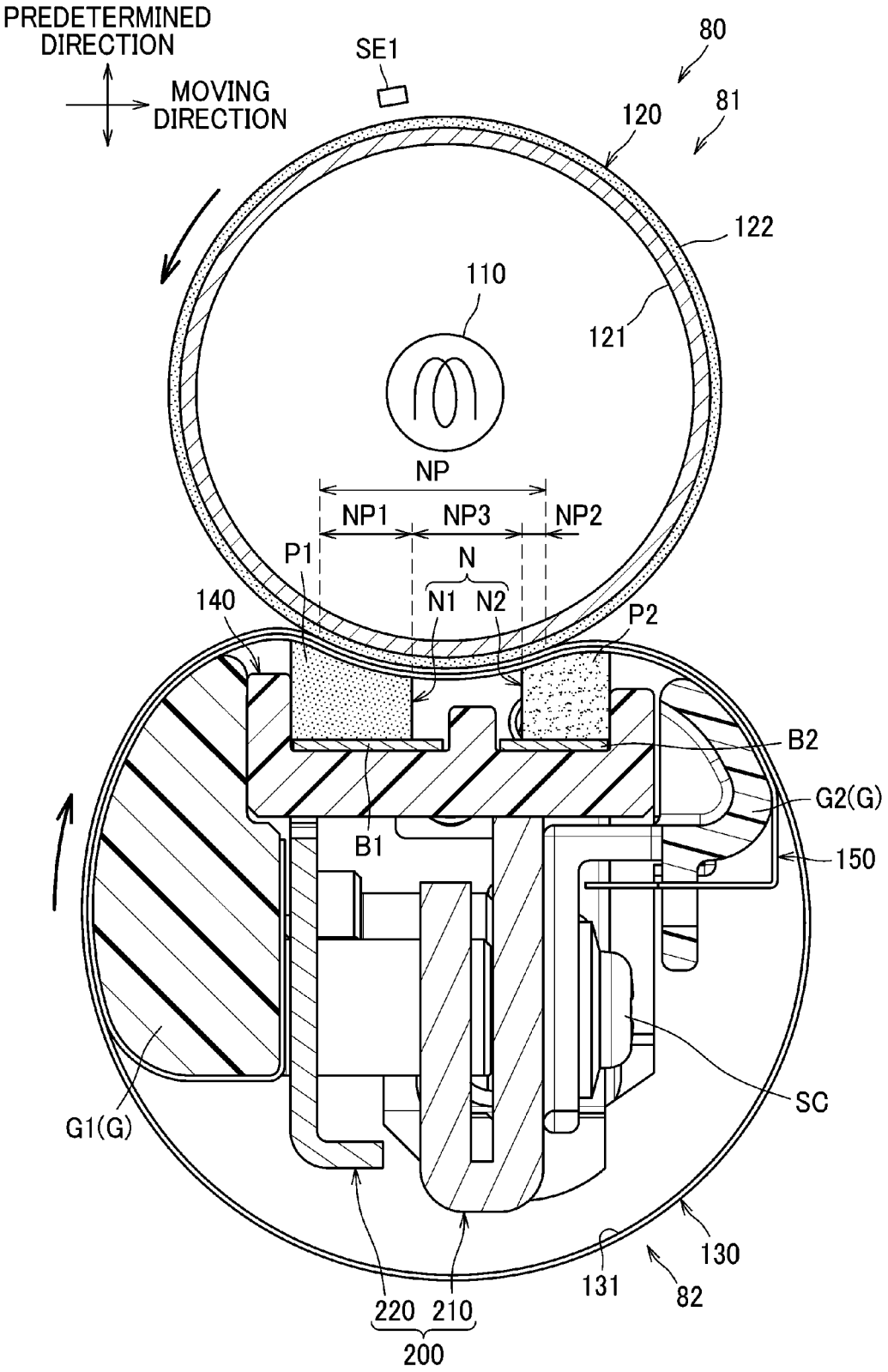
FIG. 2 is a section view of a fixing device.
Figure 3:
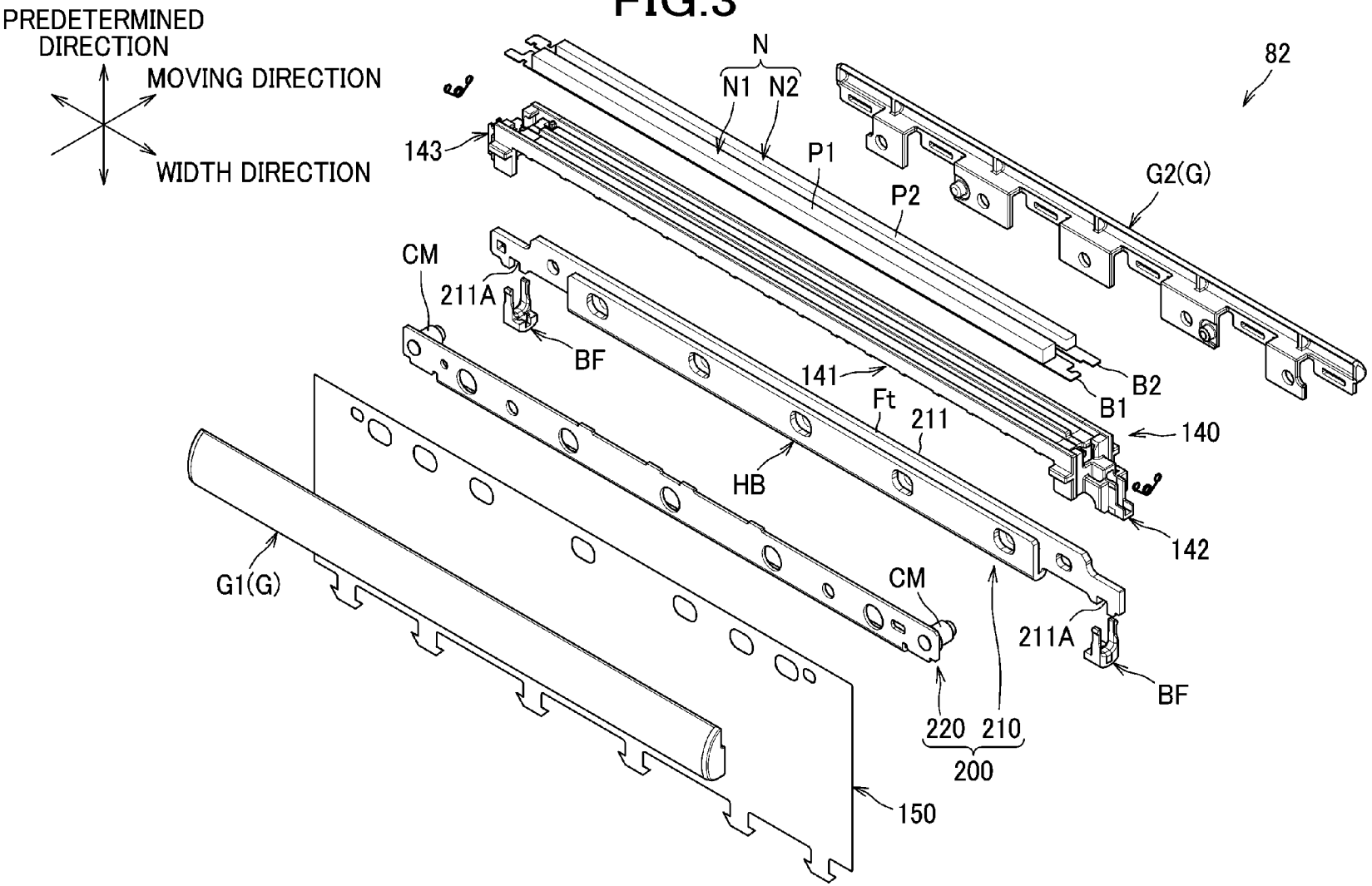
FIG. 3 is an exploded perspective view showing members arranged inside a belt.
Figure 4:
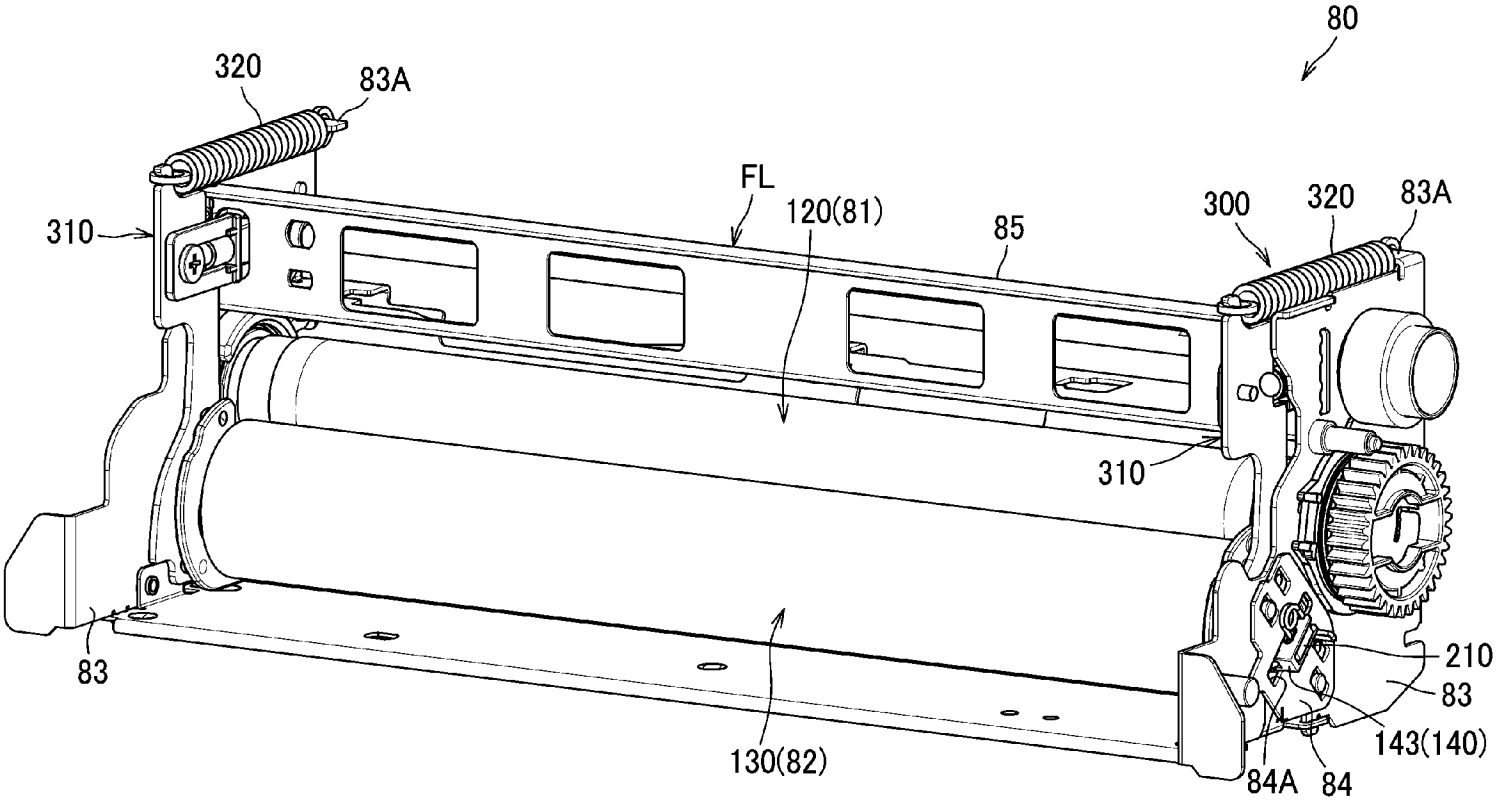
FIG. 4 is a perspective view of a pressure control mechanism.

As shown in FIG. 2, the fixing device 80 comprises a heater 110, a first fixing member 81, a second fixing member 82, a temperature sensor SE1, and a pressure control mechanism 300 (see FIG. 4). A detailed description of the pressure control mechanism 300 will be given later. The second fixing member 82 is biased toward the first fixing member 81 by the pressure control mechanism 300. In the following description, the direction in which the second fixing member 82 is biased toward the first fixing member 81 will be referred to as "predetermined direction". The predetermined direction herein is, but not limited to, a direction perpendicular to a width direction and to a moving direction. The "width direction" and "moving direction" will be described below. In other words, the predetermined direction is an orientation aligned parallel to directions in which the first fixing member 81 and the second fixing member 82 face each other.

The first fixing member 81 includes a roller 120 that is rotatable. The second fixing member 82 is a member configured to form a nip (nip region NP) in combination with the first fixing member 81. The second fixing member 82 includes a belt 130, a nip-forming member N, a holder 140, a stay 200, a belt guide G, and a slide sheet 150. The nip region NP is formed between first fixing member 81 and the second fixing member 82. To be more specific, the nip region NP is formed between the roller 120 of the first fixing member 81 and the belt 130 of the second fixing member 82. In this description, the direction of the width of the belt 130 is simply referred to as "width direction". The width direction coincides with a direction of extension of an axis of rotation of the roller 120, that is, an axial direction of the roller 120. The width direction is perpendicular to the predetermined direction.

The heater 110 comprises a halogen lamp which, when energized, generates light and heat. The heater 110 applies its radiant heat to the roller 120 to thereby cause the roller 120 to heat up. The heater 110 is disposed inside the roller 120 along the axis of rotation of the roller 120.

The roller 120 as an example of a fixing roller has a shape of a long tube with its length (axis of rotation) oriented parallel to the width direction, and is heated by the heater 110. The roller 120 comprises a tube blank 121 made of metal or the like, and an elastic layer 122 with which an outer peripheral surface of the tube blank 121 is covered. The elastic layer 122 is made of rubber, such as silicone rubber. The roller 120 is rotatably supported by side frames 83 (see FIG. 4) which will be described later. Driving force received from a fixing motor (not shown) provided in the housing 2 causes the roller 120 to rotate in a counterclockwise direction of FIG. 2.

The belt 130 is a member having a shape of a long tube (i.e., endless belt), that is, a tubular member with flexibility. To be more specific, the belt 130 forms the nip region NP in combination with the first fixing member 81 (more specifically, the roller 120); thus, the nip region NP is formed between the belt 130 and the roller 120. The belt 130, though not illustrated, comprises a base made of metal, plastic or the like, and a release layer with which an outside surface of the base is covered. The belt 130 is caused to rotate by friction with the roller 120 or the sheet S in the clockwise direction of FIG. 2 according as the roller 120 rotates. A lubricant, such as grease, is put on an inside surface 131 of the belt 130. Inside of the belt 130, the nip-forming member N, the holder 140, the stay 200, the belt guide G, and the slide sheet 150 are disposed. The belt 130 is an example of a fixing belt configured to form a nip in combination with the fixing roller (roller 120).

As shown in FIG. 2, the nip-forming member N is a member configured to form a nip region NP in combination with the roller 120 by holding the belt 130 between the roller 120 and the nip-forming member N. The nip-forming member N comprises an upstream nip-forming member N1 and a downstream nip-forming member N2.

The upstream nip-forming member N1 comprises an upstream pad P1 and an upstream fastening plate B1. The upstream pad P1 is a rectangular parallelepiped member. The upstream pad P1 is made of rubber, such as silicone rubber. The upstream pad P1 and the roller 120 hold the belt 130 therebetween to form an upstream nip region NP1.

In this description, the direction of motion of the belt 130 at the upstream nip region NP1, or the nip region NP of which a detailed description will be given later, is simply referred to as "moving direction". The moving direction in actuality varies gradually with the curved contour of the periphery (outer cylindrical surface) of the roller 120, but is herein illustrated as a direction perpendicular to the predetermined direction and to the width direction, because this direction is substantially the same direction as the direction perpendicular to the predetermined direction and to the width direction. It is to be understood that the moving direction is the same direction as a direction of conveyance of a sheet S at the nip region NP.

The upstream pad P1 is fixed to (particularly, on a roller 120 side surface of) the upstream fastening plate B1. The upstream fastening plate B1 is made of a material harder than that of the upstream pad P1. For example, the upstream fastening plate B1 may be made of metal.

The downstream nip-forming member N2 is located downstream in the moving direction of and apart from the upstream nip-forming member N1. The downstream nip-forming member N2 comprises a downstream pad P2 and a downstream fastening plate B2.

The downstream pad P2 is a rectangular parallelepiped member. The downstream pad P2 is made of rubber, such as silicone rubber. The downstream pad P2 and the roller 120 hold the belt 130 therebetween to form a downstream nip region NP2. The downstream pad P2 is located apart from the upstream pad P2 in a direction of rotation (or the moving direction) of the belt 130.

Accordingly, between the upstream nip region NP1 and the downstream nip region NP2, there exists an intervening nip region NP3 on which no pressure is directly exerted from the second fixing member 82. In this intervening nip region NP3, the belt 130 is in contact with the roller 120, but almost no pressure is applied because there is no counterpart member which holds the belt 130 in combination with the roller 120. Therefore, when a sheet S conveyed through between the roller 120 and the belt 130 passes through the intervening nip region NP3, the sheet S is subjected to heat from the roller 120 but almost not subjected to pressure. In this description, the whole region from an upstream end of the upstream nip region NP1 to a downstream end of the downstream nip region NP2, i.e., the whole region in which the outside surface of the belt 130 and the roller 120 contact each other is referred to as "nip region NP". In other words, in this example, the nip region NP covers a region on which pressing forces from the upstream pad P1 and the downstream pad P2 are not exerted.

The downstream pad P2 is fixed to (particularly, on a roller 120 side surface of) the downstream fastening plate B2. The downstream fastening plate B2 is made of a material harder than that of the downstream pad P2. For example, the downstream fastening plate B2 may be made of metal.

The upstream pad P1 has a hardness greater than a hardness of the elastic layer 122 of the roller 120. The downstream pad P2 has a hardness greater than a hardness of the upstream pad P1.

The hardness herein refers to durometer hardness as specified in ISO 7619-1. The durometer hardness is a value determined from the depth of an indentation in a test piece created by the standardized indenter under specified conditions. For example, where the elastic layer 122 has a durometer hardness of 5, it is preferable that the upstream pad P1 have a durometer hardness in a range of 6 to 10, and the downstream pad P2 have a durometer hardness in a range of 70 to 90.

The holder 140 is a member that holds the nip-forming member N. The holder 140 is made of plastic or other material having a heat-resisting property. The holder 140 comprises a holder base 141 and two engagement portions 142, 143.

The holder base 141 is a portion that holds the nip-forming member N. The holder base 141 is mostly located within a space covered by the belt 130 so as not to protrude outward from the inside of the belt 130 in the width direction. The holder base 141 includes two end portions positioned near the open sides of the belt 130 (tubular endless belt) which open outward in the width direction. The holder base 141 is supported by the stay 200.

The engagement portions 142, 143 are provided at the end portions of the holder base 141. Each of the engagement portions 142, 143 extends from the corresponding end portion of the holder base 141 outward in the width direction. The engagement portions 142, 143 are located outside the space covered by the belt 130 (at the outsides of the open sides of the belt 130 which open outward in the width direction). The engagement portions 142, 143 are engaged with respective end portions of a first stay 210 which will be described below. Specifically, the end portions of the first stay 210 with which the engagement portions 142, 143 are engaged are positioned near the open sides, which open outward in the width direction, of the tubular endless belt 130.

The stay 200 is a member located on one side of the holder 140 to support the holder 140, and the nip-forming member N supported by the holder 140 is located on the other side of the holder 140. In other words, the stay 200 and the nip-forming member N are on opposite sides of the holder 140. The stay 200 comprises a first stay 210, and a second stay 220 connected to the first stay 210 by means of a connecting member CM.

The first stay 210 is a member that supports the holder base 141 of the holder 140. The first stay 210 is made of metal or the like. The first stay 210 comprises a base portion 211, and a hemmed portion HB formed by bending the material back on itself.

The base portion 211 has, at one side thereof facing to the holder 140, a contact surface Ft that is in contact with the holder base 141 of the holder 140. The contact surface Ft is a flat surface perpendicular to the predetermined direction.

The base portion 211 having its length oriented parallel to the width direction comprises, at its both end portions, load-receiving portions 211A that receive forces from the pressure control mechanism 300 (see FIG. 4) which will be described later. The load-receiving portion 211A provided at each end portion of the base portion 211 is configured to have a recess that opens on a side facing away from the nip-forming member N in a direction parallel to the predetermined direction. In other words, each end portion of the base portion 211 has a side facing away from the nip-forming member N in the direction parallel to the predetermined direction, and the load-receiving portion 211A is formed at that side of each end portion of the base portion 211.

A buffer member BF made of plastic or the like is attached to the load-receiving portion 211A. The buffer member BF is a member which protects the base portion 211 made of metal and an arm 310 (see FIG. 4) made of metal from rubbing against each other. The configuration and features of the arm 310 will be described later in detail.

The belt guide G is a member that contacts the inside surface 131 to guide the belt 130. The belt guide G is made of plastic or other material having a heat-resisting property. The belt guide G comprises an upstream guide G1 and a downstream guide G2.

The slide sheet 150 is a rectangular sheet configured to reduce the frictional resistance between each pad P1, P2 and the belt 130. The slide sheet 150 is held at the nip region NP between the inside surface 131 of the belt 130 and each pad P1, P2. The slide sheet 150 is made of an elastically deformable material. It is to be understood that any material can be used for the slide sheet 150; herein, a sheet of plastic containing polyimide resin is adopted.

As shown in FIG. 2, the upstream guide G1, the downstream guide G2, and the first stay 210 are fastened together using a screw SC.

The temperature sensor SE1 is provided in the vicinity of the first fixing member 81. The temperature sensor SE1 detects the temperature of the first fixing member 81 and outputs a detection signal indicative of the detected temperature to the controller 100.

As shown in FIG. 4, the fixing device 80 further comprises a frame FL and a pressure control mechanism 300. The frame FL is a frame that supports the first fixing member 81 and the second fixing member 82. The frame FL is made of metal, or the like. The frame FL comprises side frames 83, brackets 84, and a connecting frame 85. The side frames 83 and the brackets 84 are provided at both sides of the first fixing member 81 and the second fixing member 82 facing outward in the width direction. The connecting frame 85 is connected to the side frames 83.

The side frames 83 are frames that support the first fixing member 81 and the second fixing member 82. Each of the side frames 83 comprises a spring engageable portion 83A configured to be engageable with one end portion of a first spring 320 which will be described later.

Each of the brackets 84 is a member that supports the second fixing member 82 in a manner that permits the second fixing member 82 to move in the predetermined direction. Each bracket 84 is fixed to the corresponding side frame 83. To be more specific, each bracket 84 has a first slot 84A elongate in the predetermined direction. The first slot 84A supports the corresponding engagement portion 142, 143 of the holder 140 whereby the end portions of the first stay 210 with which the engagement portions 142, 143 are engaged are supported movably in the predetermined direction by the first slots 84A of the brackets 84.

Figure 5A:
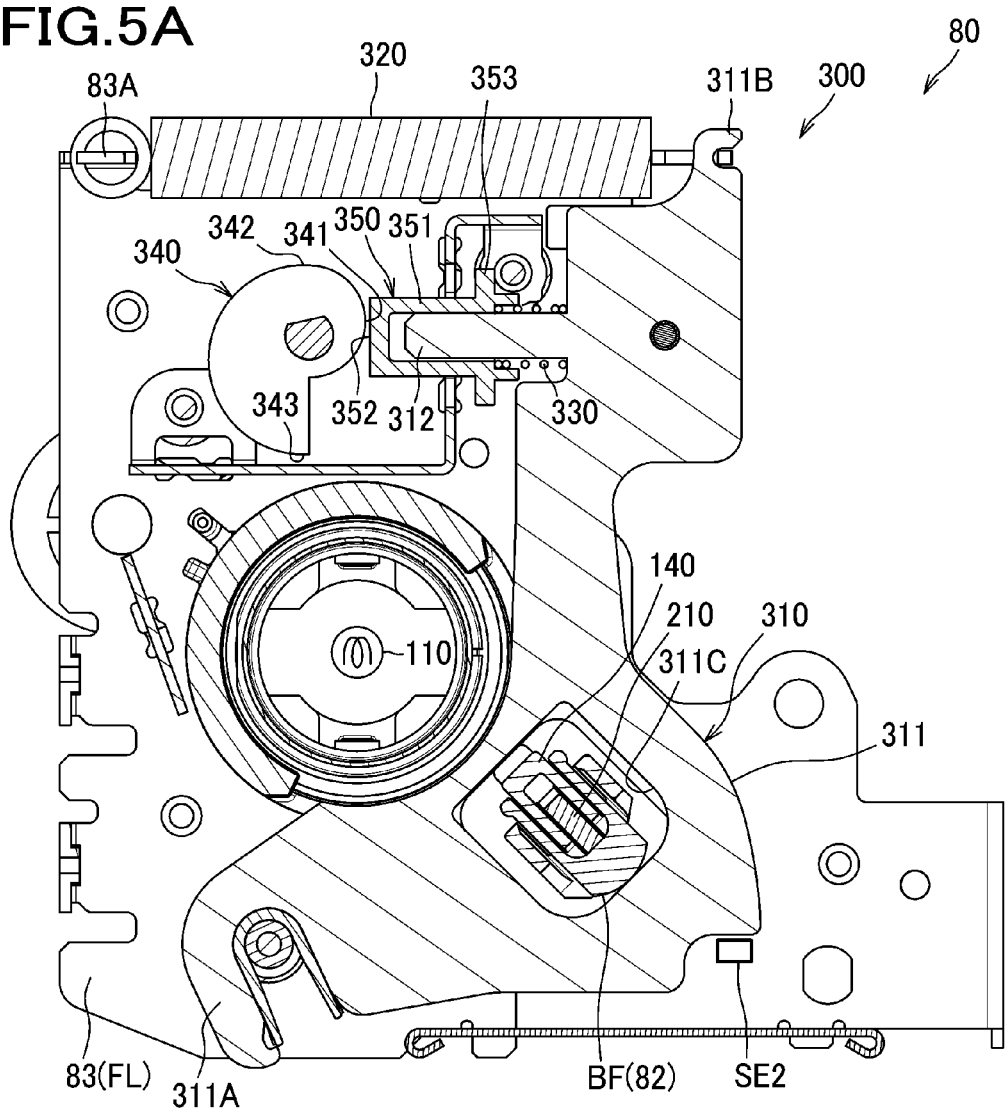
FIG. 5A is a section view of the pressure control mechanism in which a nip pressure is adjusted to a maximum nip pressure.

The pressure control mechanism 300 is a mechanism configured to change a nip pressure exerted at the nip region NP. To be more specific, the pressure control mechanism 300 is configured to be capable of adjusting the nip pressure at the nip region NP to one of a first nip pressure and a second nip pressure smaller than the first nip pressure. As shown in FIG. 4 and FIG. 5A, the pressure control mechanism 300 comprises an arm 310, a first spring 320, a second spring 330, and a cam 340. The arm 310, the first spring 320, the second spring 330, and the cam 340 are provided at each of the ends of the frame FL located apart from each other and facing outward in the width direction.

The arm 310 as an example of a pressure arm is a member configured to push the first stay 210 with the buffer member BF interposed between the arm 310 and the first stay 210. In actuality, the arm 310 pushes the buffer member BF which in turn pushes the first stay 210. Two arms 310 are provided to support the second fixing member 82, and are rotatably supported by the side frames 83.

The arm 310 comprises an arm body 311 and a cam follower 350. The arm body 311 is an L-shaped plate member made of metal or the like.

The arm body 311 comprises a first end portion 311A rotatably supported by the corresponding side frame 83, a second end portion 311B to which the first spring 320 is connected, and an engageable hole 311C in which the second fixing member 82 is supported. The engageable hole 311C is located between the first end portion 311A and the second end portion 311B, and is engaged with the buffer member BF.

The arm body 311 further comprises a guide protrusion 312 extending long toward the cam 340. The guide protrusion 312 is located closer to the second end portion 311B than to the first end portion 311A. More specifically, the guide protrusion 312 is located closer, than the engageable hole 311C, to the second end portion 311B. That is, the guide protrusion 312 is located between a first plane intersecting the second end portion 311B and a second plane intersecting the engageable hole 311C which planes are perpendicular to a straight line passing through the second end portion 311B and the engageable hole 311C.

The cam follower 350 is fitted on the guide protrusion 312 of the arm body 311 in a manner that permits the cam follower 350 to move relative to the guide protrusion 312. The cam follower 350 is contactable with the cam 340. The cam follower 350 is made of plastic or the like, and comprises a tubular portion 351, a contact portion 352, and a flange portion 353. The tubular portion 351 is a portion fitted on the guide protrusion 312. The contact portion 352 is provided at one end of the tubular portion 351. The flange portion 353 is provided at the other end of the tubular portion 351.

The tubular portion 351 is supported, by the guide protrusion 312, movably along a line parallel to the protruding direction of the guide protrusion 312. The contact portion 352 is a wall closing the one end, that is, a cam 340 side open end, of the tubular portion 351, and is located between the cam 340 and the extreme end of the guide protrusion 312. The flange portion 353 protrudes from the other end of the tubular portion 351 radially outward in a plane perpendicular to a direction of movement of the cam follower 350.

The second spring 330 is disposed between the tubular portion 351 and the arm body 311. Accordingly, the arm body 311 is configured not only to be biased by the first spring 320 but also to be able to be biased by the second spring 330.

The first spring 320 is a spring exerting a first biasing force (tensile force) on the second fixing member 82. Specifically, the first spring 320 exerts the first biasing force on the arm body 311 which in turn exerts the same first biasing force on the second fixing member 82; i.e., the first biasing force exerted on the arm body 311 acts via the arm body 311 on the second fixing member 82.

To be more specific, the biasing force of the first spring 320 is transmitted via the arm body 311, the buffer member BF, the first stay 210, and the holder 140, to thereby cause the upstream pad P1 and the downstream pad P2 to be biased toward the roller 120. The first spring 320 is a helical tension spring made of metal or the like, and has its one end connected to the spring engageable portion 83A of the side frame 83, and its other end connected to the second end portion 311B of the arm body 311.

The second spring 330 is a spring capable of exerting, on the second fixing member 82, a second biasing force (compression-resisting force) in a direction opposite to a direction of the first biasing force. Specifically, the second spring 330 is configured to be capable of exerting the second biasing force on the arm body 311 which in turn exerts the same second biasing force on the second fixing member 82; i.e., the second biasing force exerted on the arm body 311 acts via the arm body 311 on the second fixing member 82. The second spring 330 is a helical compression spring made of metal or the like, and is disposed between the tubular portion 351 and the arm body 311 with the guide protrusion 312 inserted in a space surrounded by the helical compression spring (i.e., inside the second spring 330).

The cam 340 is a member capable of changing the compression state of the second spring 330 to a first compression state in which the second biasing force is not exerted on the second fixing member 82, to a second compression state in which the second biasing force is exerted on the second fixing member 82, and to a third compression state in which the second spring 330 is deformed more than in the second compression state. The cam 340 is supported by the side frame 83 in a manner that allows the cam 340 to rotate to a first cam position shown in FIG. 5A, to an intermediate cam position (not shown), and to a second cam position shown in FIG. 6A. The intermediate cam position is a position of the cam 340 having rotated approximately 90 degrees in a clockwise direction from the first cam position as in FIG. 5A.

The cam 340 is caused to rotate by a switching motor (not shown) capable of running in forward and reverse directions. A clutch that is disengageably engageable with the cam 340 to transmit a driving force from the switching motor to the cam 340 is provided between the switching motor and the cam 340. When the switching motor is activated and the clutch is engaged, the cam 340 is caused to rotate. In this example, the switching motor serves also as a motor for causing the development rollers 53 to rotate.

The cam 340 is made of plastic or the like, and comprises a first region 341, a second region 342, and a third region 343. The first region 341, the second region 342, and the third region 343 are located on an outer surface (periphery) of the cam 340.

The first region 341 is a surface that comes in a position closest to the cam follower 350 when the cam 340 is in the first cam position. As shown in FIG. 5A, when the cam 340 is in the first cam position, the first region 341 is located apart from the cam follower 350.

The second region 342 is a surface that contacts the cam follower 350 when the cam 340 is in the intermediate cam position. To be more specific, the second region 342 comes in contact with the cam follower 350 when the cam 340 is caused to rotate from the first cam position approximately 90 degrees in the clockwise direction as in FIG. 5A. The distances from the second region 342 to the center of rotation of the cam 340 are greater than the distances from the first region 341 to the center of rotation of the cam 340.

The third region 343 is a surface that contacts the cam follower 350 when the cam 340 is in the second cam position. To be more specific, the third region 343 comes in contact with the cam follower 350 when the cam 340 is caused to rotate from the first cam position approximately 270 degrees in the clockwise direction as in FIG. 6A, i.e., when the cam 340 is caused to rotate from the intermediate cam position approximately 180 degrees in the clockwise direction as in FIG. 6A. The distances from the third region 343 to the center of rotation of the cam 340 are greater than the distances from the second region 342 to the center of rotation of the cam 340.

When the cam 340 is in the first cam position, the cam 340 is positioned apart from the cam follower 350, and thus the second spring 330 is in the first compression state. In this state, where the cam 340 leaves the second spring 330 in the first compression state, the arm body 311 assumes a first arm position shown in FIG. 5A.

To be more specific, when the cam 340 leaves the second spring 330 in the first compression state, the second biasing force of the second spring 330 is not exerted via the arm body 311 on the second fixing member 82 because the cam 340 is positioned apart from the cam follower 350, so that only the first biasing force of the first spring 320 is exerted via the arm body 311 on the second fixing member 82. In this state where the first biasing force is exerted on the second fixing member 82 by the first spring 320 and the second biasing force is not exerted on the second fixing member 82 by the second spring 330, the nip pressure takes on the maximum nip pressure.

During the process of rotation from the first cam position shown in FIG. 5A to the intermediate cam position, the cam 340 comes in contact with the cam follower 350 and causes the cam follower 350 to move for a predetermined distance relative to the arm body 311. Accordingly, the second spring 330 between the cam follower 350 and the arm body 311 deforms, and when the cam 340 is positioned in the intermediate cam position, the compression state of the second spring 330 is changed to the second compression state in which the second spring 330 is deformed (compressed) more than in the first compression state.

When the cam 340 is positioned in the intermediate cam position, the cam follower 350 is supported by the cam 340, so that the second biasing force of the second spring 330 is exerted via the arm body 311 on the second fixing member 82 in a direction reverse to the direction of the first biasing force. Therefore, where the first biasing force is exerted on the second fixing member 82 by the first spring 320 and the second biasing force is exerted on the second fixing member 82 by the second spring 330, the nip pressure takes on the intermediate nip pressure smaller than the maximum nip pressure.

When the cam 340 causes the second spring 330 to assume the second compression state, the arm body 311 remains in the first arm position described above.

Since the arm body 311 assumes the first arm position regardless of whether the second spring 330 is in the first compression state or in the second compression state as described above, both of the upstream pad P1 and the downstream pad P2 serve to hold the belt 130 so that the belt 130 is held between the upstream pad P1 and the roller 120 and between the downstream pad P2 and the roller 120, under the both nip conditions: the condition in which the nip pressure takes on the maximum nip pressure; and the condition in which the nip pressure takes on the intermediate nip pressure. More specifically, the position of the second fixing member 82 relative to the roller 120 is substantially the same under the both conditions, and thus the length (dimension in the moving direction) of the nip region NP is substantially the same under the both conditions.

Herein, the maximum nip pressure or the intermediate nip pressure is a first nip pressure to be set when a printing process is executed, i.e., when toner images are fixed on a sheet. For example, if the sheet S has a first thickness, the nip pressure is set at the maximum nip pressure, while if the sheet S has a second thickness greater than the first thickness, the nip pressure is set at the intermediate nip pressure.

The first cam position and the intermediate cam position are first positions in which the nip pressure takes on the maximum nip pressure or the intermediate nip pressure, i.e., the first nip pressure. Similarly, the second cam position is a second position in which the nip pressure takes on the minimum nip pressure, i.e., the second nip pressure.

Figure 6A:
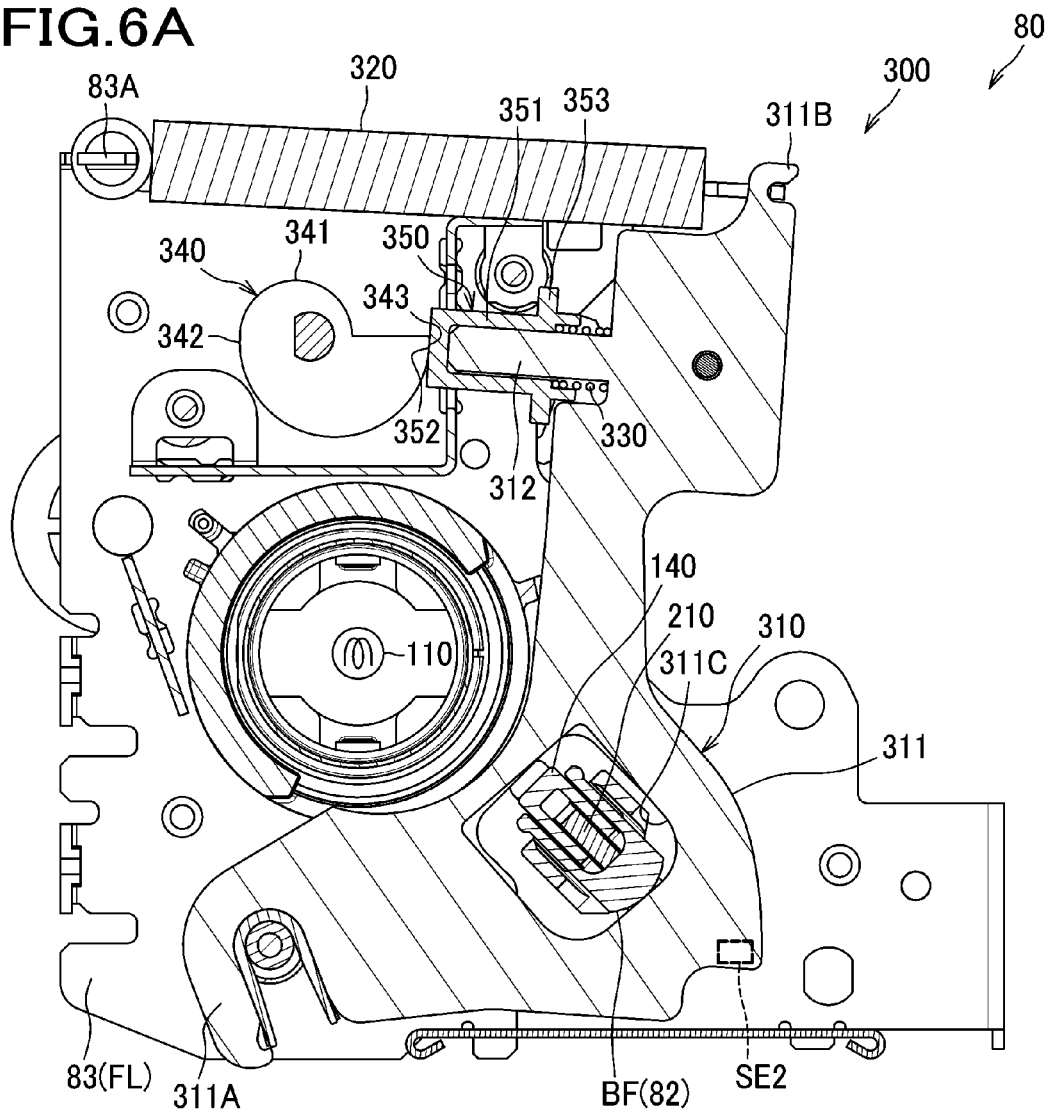
FIG. 6A is a section view of the pressure control mechanism in which the pressure is adjusted to a second nip pressure.

When the cam 340 is caused to rotate from the intermediate cam position to the second cam position shown in FIG. 6A, the cam follower 350 is further caused to move relative to the arm body 311; accordingly, the contact portion 352 not only comes in contact with the cam 340, but also comes in contact with the guide protrusion 312. The cam 340 causes the arm body 311 to rotate via the cam follower 350, so that the arm body 311 is positioned from the first arm position to a second arm position different from the first arm position.

Figure 5B:
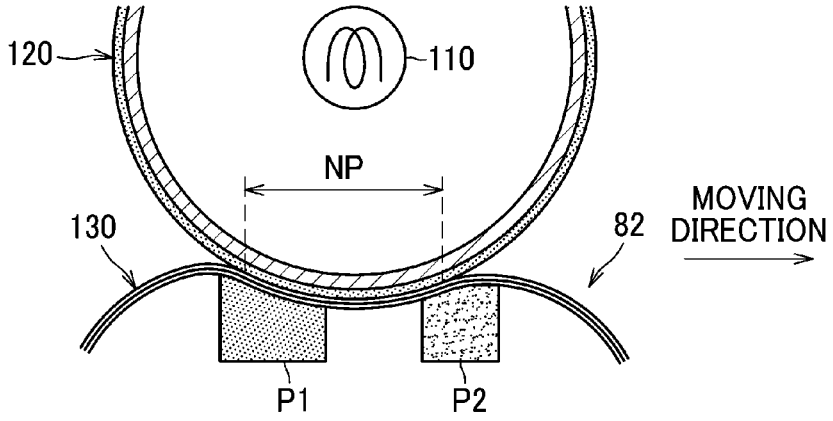
FIG. 5B is a section view of a nip region, with its surrounding structural features formed when the nip pressure takes on the maximum nip pressure.
Figure 6B:
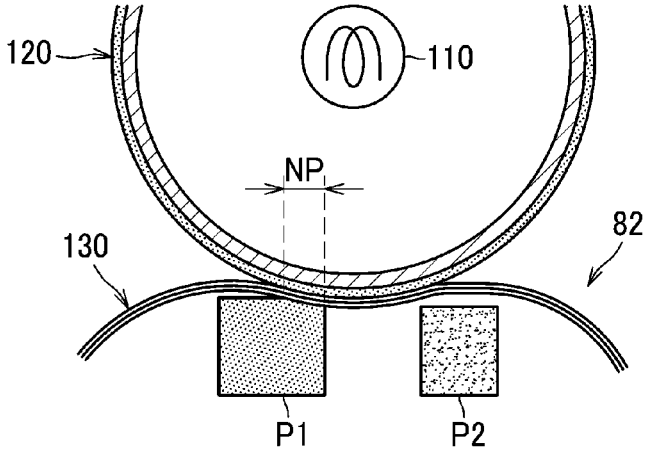
FIG. 6B is a section view showing a nip region, with its surrounding structural features formed when the nip pressure takes on the second nip pressure.

When the arm body 311 is in the second arm position, the second fixing member 82 is located in a position (position shown in FIG. 6B) farther apart from the roller 120 than a position (position in FIG. 5B) in which the second fixing member 82 is located when the arm body 311 is in the first arm position. Such change in the position of the second fixing member 82 relative to the roller 120 makes the length (dimension in the moving direction) of the nip region NP formed when the arm body 311 is in the second arm position smaller than that formed when the arm body 311 is in the first arm position, as shown in FIG. 6B, and the nip pressure is changed to the minimum nip pressure smaller than the intermediate nip pressure. That is, the position of the arm 310 is changed by the cam 340 whereby the nip pressure and the nip length are changed. To be more specific, when the arm 310 is in the second arm position, the belt 130 is held only between the upstream pad P1 and the roller 120 but not held between the downstream pad P2 and the roller 120. Therefore, when the arm 310 is in the second arm position, the upstream nip pressure and the upstream nip length become smaller, and the downstream nip pressure becomes zero.

Herein, the minimum nip pressure is a second nip pressure to be set when a printing process is not executed, i.e., when the fixing motor (not shown) is stopped. In this example, when the nip pressure takes on the minimum nip pressure, rotation of the roller 120 causes the belt 130 to rotate accordingly. It is to be understood that the minimum nip pressure is set not only when the printing process is not executed, but also when a specified type of sheet, such as an envelope, etc., is to be subject to printing.

The fixing device 80 further comprises a position sensor SE2 for determining whether the nip pressure takes on the first nip pressure or the second nip pressure. The position sensor SE2 is a sensor that detects the position of the second fixing member 82. To be more specific, the position sensor SE2 is located near a nip release position, and detects the second fixing member 82 that has come to a position in the vicinity of the nip release position. For example, the position sensor SE2 is located in a position, as shown in FIG. 5A, in which the swinging motion of the arm body 311 is detectable. It is to be understood that the position sensor SE2 may be located in any position as long as it can detect any part or member of which motion is linked with the motion of the second fixing member 82.

The following discussion focuses on a process of control exercised by the controller 100 over the fixing device 80 when the first fixing member 81 is caused to heat up to a standby temperature Tr lower than a fixing temperature. The control process starts from a state in which rotation of the first fixing member 81 is stopped. Herein, the control mode in which the fixing device 80 is on standby with the first fixing member 81 being kept at the standby temperature Tr is referred to as "ready mode".

The controller 100 includes a central processing unit (CPU), a random-access memory (RAM), a read-only memory (ROM), a nonvolatile memory, an application-specific integrated circuit (ASIC), an input/output circuit, and other elements. The controller 100 performs various kinds of arithmetic and logic operations based on a printing instruction outputted from an external computer and programs and data stored in storages such as ROM to thereby execute various processes.

After completion of the printing process, the controller 100 executes a process of changing the nip pressure from the first nip pressure to the second nip pressure. Therefore, in the ready mode or in a sleep mode in which the first fixing member 81 is put on standby with its temperature kept at a temperature lower than that in the ready mode, the nip pressure is set at the second nip pressure. Under normal circumstances, the initial nip pressure at power-on, except when power failed under the nip pressure set at the first nip pressure, or other occasions, is set at the second nip pressure.

From a state in which the rotation of the first fixing member 81 is stopped, the controller 100 executes a control process for transition to the ready mode. This control process includes a first process, a second process, a third process, a fourth process, and a fifth process, to be executed in this sequence.

The first process is executed in a state where the nip pressure is set at the second nip pressure. If the nip pressure is set at the first nip pressure at the start of transition to the ready mode, the controller 100 controls the switching motor and the clutch, thereby causes the cam 340 to rotate, and changes the nip pressure to the second nip pressure in advance, and thereafter starts temperature control by means of the heater 110. The first process is a process of activating and controlling the heater 110 to cause the first fixing member 81 to heat up toward a target temperature TT. In the temperature control, the controller 100 sets the target temperature TT, and regulates an output of the heater 110 to cause a detected temperature T being detected by the temperature sensor SE1 to approach the target temperature TT.

The second process is a process of starting the rotation of the first fixing member 81. The second process follows close on the first process. When the controller 100 starts the rotation of the first fixing member 81 in the second process, the nip pressure is set at the second nip pressure. The controller 100, in the second process, activates the fixing motor to start the rotation of the first fixing member 81, after the detected temperature T of the first fixing member 81 has reached a first predetermined temperature Tp1. In this example, when the controller 100 determines that the detected temperature T has become higher than the first predetermined temperature Tp1, the controller 100 starts causing the fixing motor to operate.

The third process is a process of changing the nip pressure from the second nip pressure to the first nip pressure. Change in the nip pressure from the second nip pressure to the first nip pressure is made while the first fixing member 81 is rotating. In this example, the controller 100, in the third process, changes the nip pressure from the second nip pressure to the first nip pressure at a time when a first predetermined period TM1 has elapsed from a time of starting the rotation of the first fixing member 81.

The fourth process is a process of changing the nip pressure from the first nip pressure to the second nip pressure. Change in the nip pressure from the first nip pressure to the second nip pressure is made while the first fixing member 81 is rotating. In this example, the controller 100, in the fourth process, changes the nip pressure from the first nip pressure to the second nip pressure at a time when a second predetermined period TM2 has elapsed from a time of changing the nip pressure from the second nip pressure to the first nip pressure in the third process. The second predetermined period TM2 is set at a period of time long enough for the detected temperature T to get sufficiently close to the standby temperature Tr, that is, such that the detected temperature T gets close to the standby temperature Tr around a time when the second predetermined period TM2 has elapsed from the time of changing the nip pressure from the second nip pressure to the first nip pressure.

The fifth process is a process of stopping the rotation of the first fixing member 81. The fifth process follows close on the fourth process. When the rotation of the first fixing member 81 is stopped, the nip pressure is set at the second nip pressure. In this example, the controller 100, in the fifth process, stops the rotation of the first fixing member 81 at a time when a third predetermined period TM3 has elapsed from a time of changing the nip pressure from the first nip pressure to the second nip pressure in the fourth process.

Figure 9:
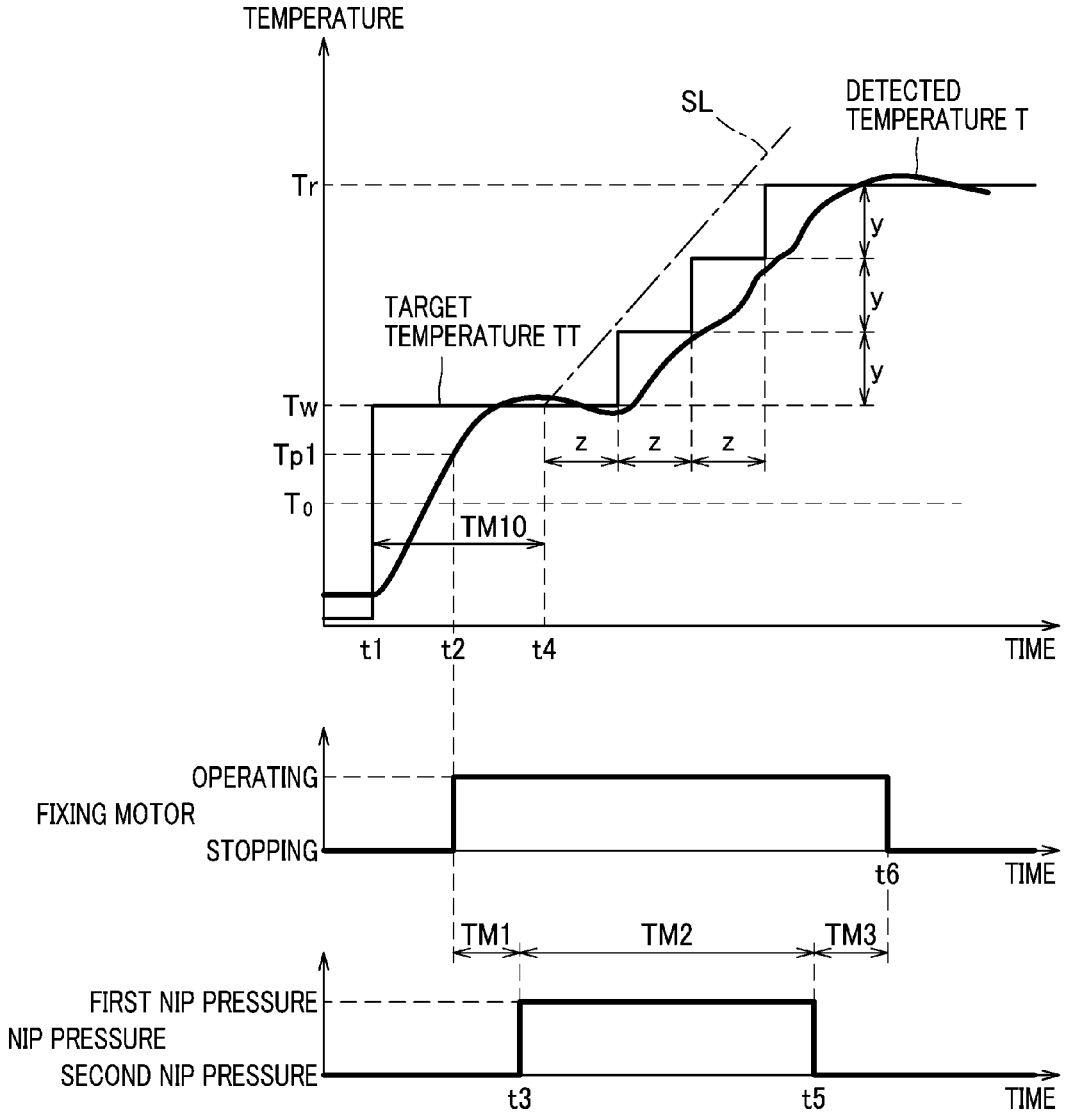
Figure 10:
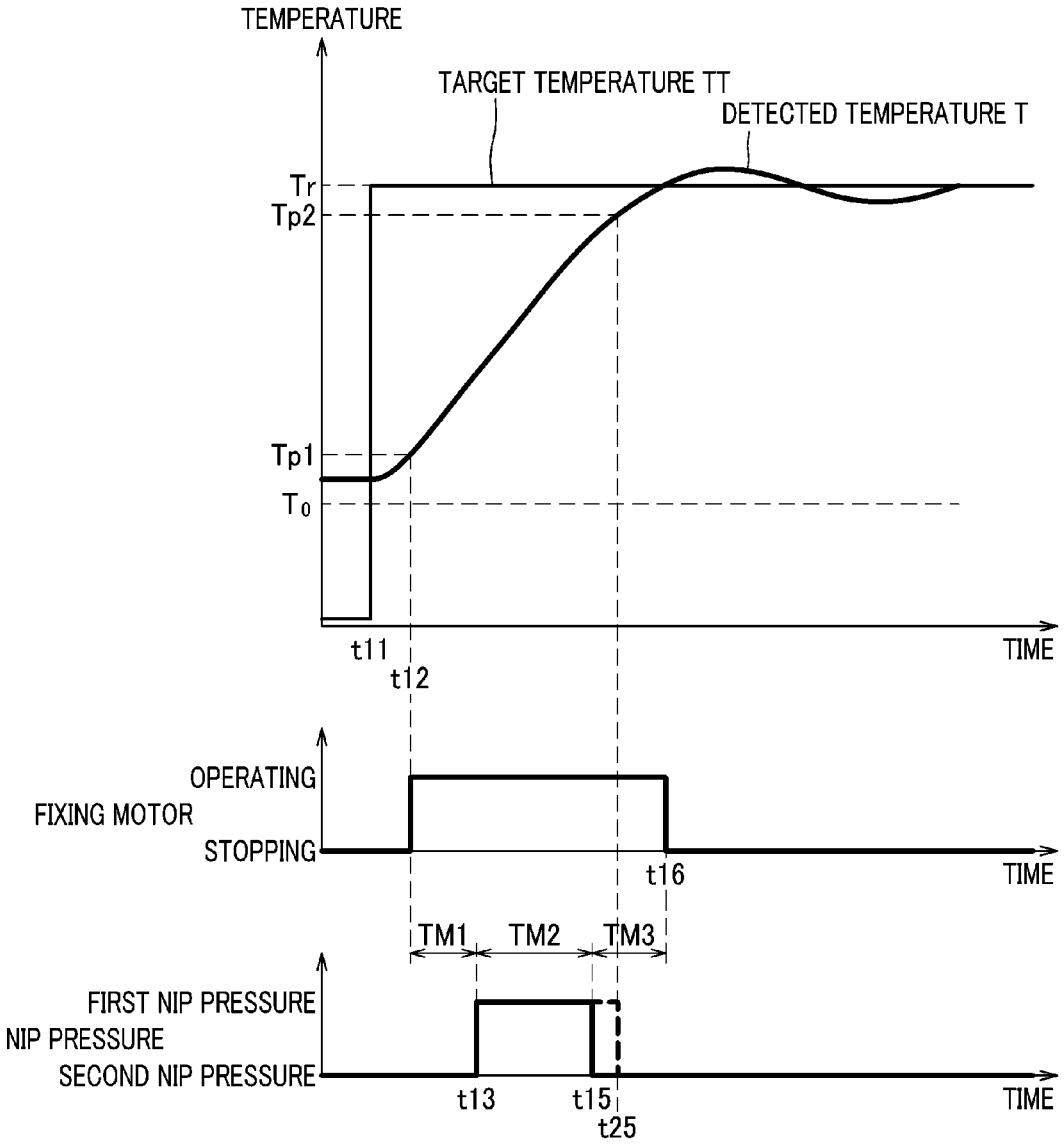

When starting the transition to the ready mode from a state in which the first fixing member 81 is stopped, the controller 100 sets a target temperature TT. The controller 100 sets the target temperature TT in accordance with an initial temperature that is a temperature of the first fixing member 81 as determined when the heater 110 is activated in the first process. It is to be understood that the temperature of the first fixing member 81 as determined when the heater 110 is activated in the first process includes a temperature just before or just after the time at which the heater 110 heater 81 is caused to start operating. As shown in FIG. 9, the controller 100 first sets the target temperature TT at a predetermined temperature Tw higher than a third predetermined temperature To if the initial temperature is lower than the third predetermined temperature To. Then, after a predetermined period TM10 has elapsed from a time of starting the temperature control, the target temperature TT is raised stepwise toward the standby temperature Tr in such a manner that the target temperature TT moves up stepwise but each raised temperature almost does not exceed a reference temperature increasing with a predetermined slope SL. In other words, the target temperature TT increases at a rate smaller than a predetermined rate of increase in temperature (as indicated by the slope SL) for a period of time over which the detected temperature increases from the predetermined temperature Tw to the standby temperature Tr. Accordingly, if the detected temperature T is still far short of the standby temperature Tr, i.e., appreciably low, then the heater 110 is caused to operate to raise the temperature of the first fixing member 81 quickly toward the predetermined temperature Tw; while after the detected temperature T gets close to the standby temperature Tr, the target temperature TT is raised to a moderate degree at each time toward the standby temperature Tr. Therefore, the temperature of the first fixing member 81 can be restrained from overshooting in excess of the standby temperature Tr. In this process, the controller 100 sets the second predetermined period TM2 (for which the first fixing member 81 is caused to rotate under the first nip pressure) at a longer period TM2long. On the other hand, as shown in FIG. 10, if the initial temperature is equal to or higher than the third predetermined temperature To, the controller 100 sets the target temperature TT at the standby temperature Tr from the beginning. Accordingly, if the initial temperature is high enough, the heater 110 can be caused to operate to raise the temperature of the first fixing member 81 quickly to the standby temperature Tr by the setting of the target temperature TT at the standby temperature Tr from the beginning. In this situation, the controller 100 sets the second predetermined temperature TM2 (for which the first fixing member 81 is caused to rotate under the first nip pressure) at a shorter period TM2short that is shorter than the period TM2long.

Herein, the predetermined slope SL of the increasing reference temperature is determined, for example, in such a manner that the detected temperature T becomes the standby temperature Tr after a time at which the second predetermined period TM2 has elapsed from a time of changing the nip pressure from the second nip pressure to the first nip pressure in the third process. This is advantageous to allow sufficient time for the belt 130 to be caused to rotate with the first nip pressure until the detected temperature T reaches the standby temperature Tr.

Next, referring to the flowchart of FIG. 7, one example of a process executed by the controller 100 for transition to the ready mode will be described below.

Figure 7:
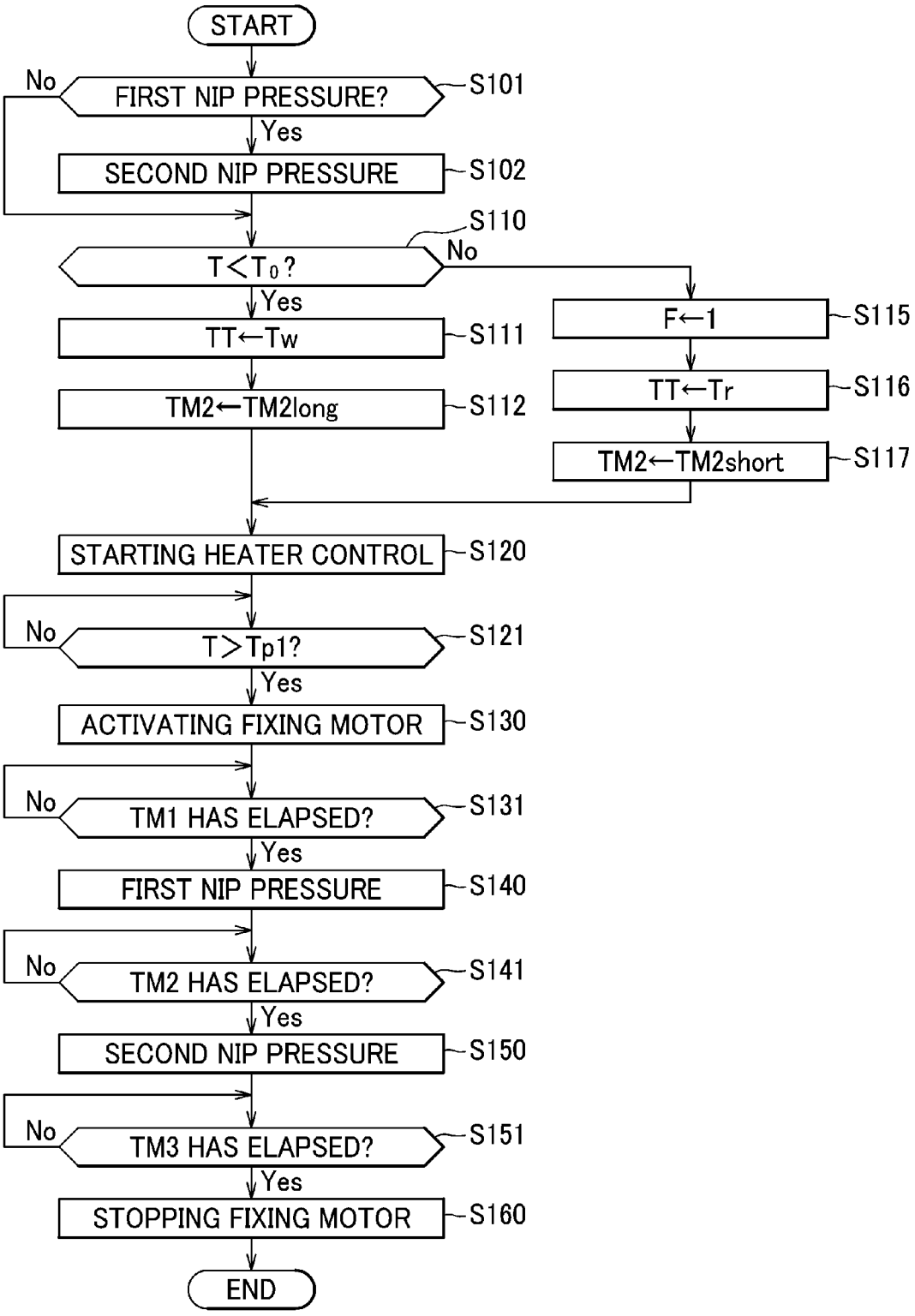
FIG. 7 is a flowchart showing one example of a process executed by a controller during transition to a ready mode.

The controller 100 starts the process of FIG. 7 after the power-on or in response to an operation on an operation panel by a user during a sleep mode. To start a process of transition to the ready mode, the controller 100 first determines, based on a signal from the position sensor SE2, whether the nip pressure is set at the first nip pressure or the second nip pressure (S101), and if it is set at the first nip pressure (Yes in step S101), then causes the cam 340 to rotate to change the nip pressure to the second nip pressure (S102). On the other hand, if the nip pressure is set at the second nip pressure (No in step S101), then the controller 100 does not change the nip pressure, and proceeds to step S110.

Next, the controller 100 determines whether or not the detected temperature T, i.e., the initial temperature, is lower than the third predetermined temperature To (S110). If the controller 100 determines that the detected temperature T is lower than the third predetermined temperature To (Yes in step S110), then the controller 100 sets the target temperature TT at the temperature Tw (S111), and sets the second predetermined period TM2 at TM2long (S112).

On the other hand, if the initial temperature is not lower than the third predetermined temperature To (No in step S110), then the controller 100 updates a flag F from 0 to 1 (S115), sets the target temperature TT at the standby temperature Tr (S116), and sets the second predetermined period TM2 at TMshort (S117). The flag F herein refers to a flag for indicating that the initial temperature is not lower than the third predetermined temperature To.

After step S112 or step S117, the controller 100 starts temperature control over the heater 110, and causes the first fixing member 81 to heat up toward the target temperature TT (S120; first process). Subsequently, the controller 100 determines whether or not the detected temperature T has become higher than the first predetermined temperature Tp1 (S121), and continues the temperature control until the detected temperature T becomes higher than the first predetermined temperature Tp1 (No in step S121). If the controller 100 determines that the detected temperature T has become higher than the first predetermined temperature Tp1 (Yes in step S121), then the controller 100 activates the fixing motor to start rotation of the first fixing member 81 (S130, second process).

Next, the controller 100 determines whether or not the first predetermined period TM1 has elapsed from a time of starting the rotation of the first fixing member 81 (S131), and waits until the first predetermined period TM1 elapses (No in step S131). If the controller 100 determines that the first predetermined period TM1 has elapsed from the time of starting the rotation of the first fixing member 81 (Yes in step S131), then the controller 100 causes the cam 340 to rotate and changes the nip pressure from the second nip pressure to the first nip pressure (S140, third process).

Next, the controller 100 determines whether or not the second predetermined period TM2 has elapsed from a time of changing the nip pressure from the second nip pressure to the first nip pressure (S141), and waits until the second predetermined period TM2 elapses (No in step S141). If the controller 100 determines that the second predetermined period TM2 has elapsed from the time of changing the nip pressure from the second nip pressure to the first nip pressure (Yes in step S141), then the controller 100 causes the cam 340 to rotate and changes the nip pressure from the first nip pressure to the second nip pressure (S150, fourth process).

Next, the controller 100 determines whether or not a third predetermined period TM3 has elapsed from a time of changing the nip pressure from the first nip pressure to the second nip pressure (S151), and waits until the third predetermined period TM3 elapses (No in step S151). If the controller 100 determines that the third predetermined period TM3 has elapsed (Yes in step S151), then the controller 100 stops the fixing motor to stop the rotation of the first fixing member 81 (S161, fifth process). In this way, the transition to the ready mode is completed.

Next, referring to the flowchart of FIG. 8, one example of a process executed by the controller 100 for setting the target temperature TT during transition to the ready mode will be described below.

Figure 8:
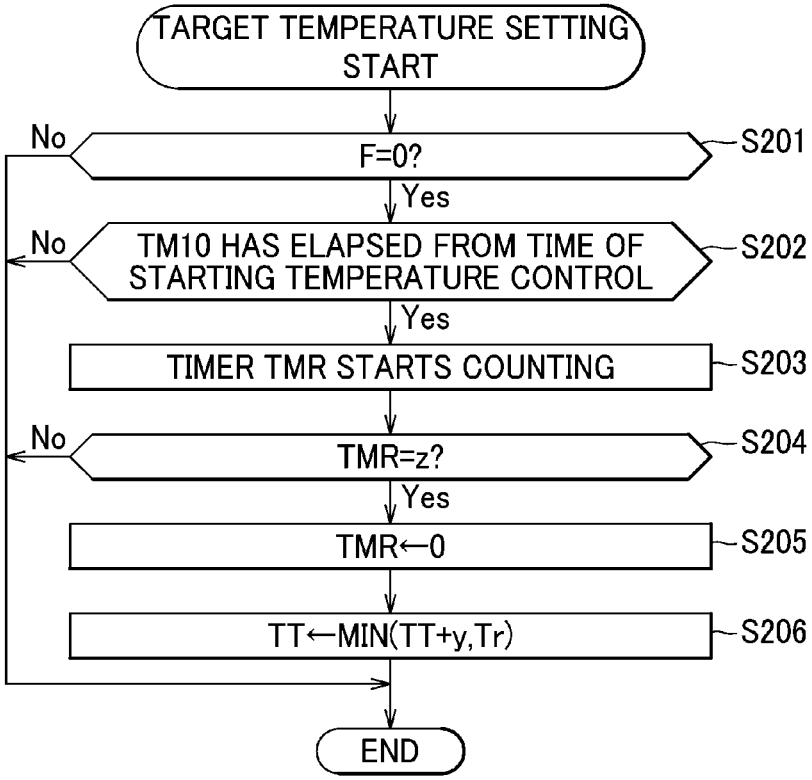
FIG. 8 is a flowchart showing one example of a target temperature setting process executed by the controller during transition of the ready mode.

The process shown in FIG. 8 is executed from a time when the target temperature TT has been set for the first time in step S111 or S116 of the process of FIG. 7, repeatedly for each predetermined period of time, in parallel with the process of FIG. 7.

The controller 100 determines whether or not the flag F is 0 (S201); if the controller 100 determines that the flag F is not 0 (No in step S201), then the controller 100 brings the process to an end without changing the target temperature TT.

If the controller 100 determines that the flag F is 0 (Yes in step S201), the controller 100 then determines whether or not the predetermined period TM10 has elapsed from a time of starting the temperature control (S202). If the controller 100 determines that the predetermined period TM10 has not elapsed from the time of starting the temperature control (No in step S202), then the controller 100 brings the process to an end without changing the target temperature TT.

If the controller 100 determines that the predetermined period TM10 has elapsed from the time of starting the temperature control (Yes in step S202), then the controller 100 causes the timer TMR to start counting (S203). Thereafter, the controller 100 determines whether or not the timer TMR has counted to a predetermined value z (S204). If the controller 100 determines that the timer TMR has not yet counted to the predetermined value z (No in step S204), then the controller 100 brings the process to an end. On the other hand, if the controller 100 determines that the timer TMR has counted to the predetermined value z (Yes in step S204), the controller 100 then resets the timer TMR to 0 (S205), and sets the target temperature TT at either one of two temperatures, whichever lower, of: a temperature obtained by adding a predetermined value y to the currently set target value TT; and the standby temperature Tr. In other words, the controller 100 raises the target temperature TT in an increment of y each time a period corresponding to the predetermined value z elapses, and if the TT+y exceeds the standby temperature Tr, then sets the target temperature TT at the standby temperature Tr.

A description will now be given of one example of operations carried out by the fixing device 80 in the color printer 1 as described above, from a state in which the rotation of the first fixing member 81 is stopped, for transition to the ready mode, with reference to FIG. 9 and FIG. 10.

If the initial temperature determined when a control process for transition to the ready mode is started from a state in which the rotation of the first fixing member 81 is stopped, is lower than the third predetermined temperature To, as shown in FIG. 9, at a time t1, the target temperature TT is set at the temperature Tw lower than the standby temperature Tr, and the heater 110 is caused to start heating the first fixing member 81. When the temperature of the first fixing member 81 is raised to the first predetermined temperature Tp1, the controller 100 activates the fixing motor at a time t2. At this time, the nip pressure is set at the second nip pressure, and thus the damage to the belt 130 at a time of starting the operation of the belt 130 can be mitigated. When the first predetermined period TM1 has elapsed from a time of starting to cause the fixing motor to operate, the controller 100 changes the nip pressure from the second nip pressure to the first nip pressure (t3), thereafter keeps the nip pressure at first nip pressure for the second predetermined period TM2 to efficiently transfer heat from the first fixing member 81 to the second fixing member 82, so that the both of the first fixing member 81 and the second fixing member 82 can be heated efficiently. After the predetermined period TM10 has elapsed (t4) from a time of starting the temperature control (t1), the controller 100 raises the target temperature TT in an increment of y each time a period corresponding to the value z as counted by the timer TMR elapses. Accordingly, the mean rise rate of the target temperature TT is adjusted to a value not exceeding the reference temperature increasing with the predetermined slope SL.

When the second predetermined period TM2 has elapsed from the time of changing the nip pressure from the second nip pressure to the first nip pressure, the controller 100 changes the nip pressure from the first nip pressure to the second nip pressure (t5), and then waits until the third predetermined period TM3 elapses. When the third predetermined period TM3 has elapsed from the time t5, the controller 100 stops the fixing motor (t6). At this time, the nip pressure is set at the second nip pressure, and thus the damage to the belt 130 at a time of stopping the belt 130 can be mitigated.

If the initial temperature determined when the control process for transition to the ready mode is started from a state in which the rotation of the first fixing member 81 is stopped is equal to or higher than the third predetermined temperature To, as shown in FIG. 10, at a time t11, the target temperature TT is set at the standby temperature Tr, and the heater 110 is caused to start heating the first fixing member 81. When the temperature of the first fixing member 81 is raised to the first predetermined temperature Tp1, the controller 100 activates the fixing motor at a time t12. At this time, the nip pressure is set at the second nip pressure, and thus the damage to the belt 130 at a time of starting the operation of the belt 130 can be mitigated. When the first predetermined period TM1 has elapsed from a time of starting to cause the fixing motor to operate, the controller 100 changes the nip pressure from the second nip pressure to the first nip pressure (t13), thereafter keeps the nip pressure at the first nip pressure for the second predetermined period TM2 to efficiently transfer heat from the first fixing member 81 to the second fixing member 82, so that the both of the first fixing member 81 and the second fixing member 82 can be heated efficiently.

When the second predetermined period TM2 has elapsed from the time of changing the nip pressure from the second nip pressure to the first nip pressure, the controller 100 changes the nip pressure from the first nip pressure to the second nip pressure (t15), and then waits until the third predetermined period TM3 elapses. When the third predetermined period TM3 has elapsed from the time t15, the controller 100 stops the fixing motor (t16). At this time, the nip pressure is set at the second nip pressure, and thus the damage to the belt 130 at a time of stopping the belt 130 can be mitigated.

In the color printer 1 configured as described above, the following advantageous effects can be achieved.

When the rotation of the first fixing member 81 is started, the nip pressure between the first fixing member 81 and the second fixing member 82 is set at the second nip pressure that is a relatively smaller nip pressure (smaller than the first nip pressure) as described above; therefore, damage to the belt 130 at the time of starting the operation of the belt 130 can be mitigated. In addition, after the rotation of the first fixing member 81 is started under the second nip pressure, the nip pressure is changed to the first nip pressure greater than the second nip pressure as described above; therefore, heat transfer is facilitated so that the heat can be transferred quickly from the first fixing member 81 to the second fixing member 82.

Since the rotation of the first fixing member 81 is stopped after the change of the nip pressure from the first nip pressure to the second nip pressure, the damage of the belt 130 at the time of stopping the rotation can also be mitigated. Accordingly, in the color printer 1 configured as described above, when the temperature of the first fixing member 81 is raised to the standby temperature Tr, the damage to the belt 130 can be mitigated and the second fixing member 82 can be heated sufficiently at the same time.

Moreover, in the color printer 1 configured as described above, the rotation of the first fixing member 81 is started after lubricant applied to the belt 130 has become warm; therefore, the damage to the belt 130 can be mitigated.

Moreover, in the color printer 1 configured as described above, the belt 130 is rotated under a smaller nip pressure for the first predetermined period TM1; therefore, the belt 130 can be moved smoothly, and the damage to the belt 130 can be mitigated.

Moreover, in the color printer 1 configured as described above, the belt 130 is rotated under the first nip pressure for the second predetermined period TM2; therefore, heat can be transferred from the first fixing member 81 to the second fixing member 82 efficiently so that the second fixing member 82 can be heated sufficiently.

When the initial temperature is low, the rise in temperature of the first fixing member 81 is likely to be delayed, and thus the temperature of the first fixing member 81 would be liable to overshoot. In this respect, the color printer 1 described above is configured to cause the target temperature TT to move up stepwise at such a rate as not to exceed the reference temperature increasing with the predetermined slope SL; therefore, the overshoot of the temperature can be restrained.

When the color printer 1 configured as described above is stopped or put on standby, the belt 130 is held between the upstream pad P1 and the first fixing member 81, but not held between the downstream pad P1 and the first fixing member 81, and thus the load imposed on the second fixing member 82 can be reduced.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

For example, in the above-described embodiment, the controller 100 is configured to change the nip pressure from the first nip pressure to the second nip pressure in the fourth process at a time when the second predetermined period TM2 has elapsed from the time of changing the nip pressure from the second nip pressure to the first nip pressure in the third process, but alternatively, may be configured to change the nip pressure from the first nip pressure to the second nip pressure in the fourth process at either a time when the second predetermined period TM2 has elapsed from the time of changing the nip pressure from the second nip pressure to the first nip pressure in the third process or a time when the temperature of the first fixing member 81 has become equal to or higher than the second predetermined temperature Tp2 that is lower than the standby temperature Tr, whichever comes later.

In this alternative example, as shown by broken lines in FIG. 10, the nip pressure is not changed at the time t15 when the second predetermined period TM2 has elapsed from the time of changing the nip pressure from the second nip pressure to the first nip pressure, but is changed from the first nip pressure to the second nip pressure at the time t25 when the detected temperature T has become equal to or higher than the second predetermined temperature Tp2. With this configuration, the belt 130 is caused to rotate under the first nip pressure for the second predetermined period TM2, and the belt 130 is caused to keep rotating until the temperature of the first fixing member 81 becomes the second predetermined temperature Tp2; therefore, heat can be transferred from the first fixing member 81 to the second fixing member 82 sufficiently without fail.

In the above-described embodiment, the color printer 1 is illustrated as an example of an image forming apparatus; however, the image forming apparatus may be a monochrome image forming apparatus, a copier, a multifunction device, or the like.

In the above-described embodiment, the first nip pressure is illustrated to comprise a maximum nip pressure and an intermediate nip pressure; however, the image forming apparatus without the intermediate nip pressure may be feasible. In this alternative example, the maximum nip pressure is the first nip pressure.

In the above-described embodiment, the illustrated configuration is such that when the nip pressure is set at the second nip pressure, the belt 130 is held only between the upstream pad P1 and the roller 120, and is not held between the downstream pad P2 and the roller 120; alternatively, when the nip pressure is set at the second nip pressure, the belt 130 may be held not only between the upstream pad P1 and the roller 120 but also between the downstream pad P2 and the roller 120.

In the above-described embodiment, the third process of changing the nip pressure from the second nip pressure to the first nip pressure is executed at the time when the first predetermined period TM1 has elapsed from the time of starting to cause the fixing motor to operate; however, the time of changing the nip pressure from the second nip pressure to the first nip pressure may alternatively be determined based on the detected temperature T. In the above-described embodiment, the fourth process of changing the nip pressure from the first nip pressure to the second nip pressure is executed at the time when the second predetermined period TM2 has elapsed from the time of changing the nip pressure from the second nip pressure to the first pressure; however, the time of changing the nip pressure from the first nip pressure to the second nip pressure may be determined based on the detected temperature T. Similarly, the fifth process of stopping the fixing motor to stop the rotation of the first fixing member 81 may be executed at a time as determined based only on the detected temperature T.

In the above-described embodiment, the fixing motor is activated, in the second process, when the temperature of the first fixing member 81 has reached the first predetermined temperature Tp1; however, the fixing motor may alternatively be activated at a time when a predetermined period has elapsed from the time when the temperature of the first fixing member 81 has reached the first predetermined temperature Tp1.

The elements described in the above embodiment and its modified examples may be implemented selectively and in combination.

What is claimed is:

1. An image forming apparatus, comprising:

a first fixing member including a roller that receives a driving force from a motor;

a second fixing member including a belt configured to form a nip in combination with the first fixing member;

a heater configured to heat the first fixing member;

a pressure control mechanism configured to be capable of changing a nip pressure exerted at the nip formed between the first fixing member and the second fixing member, to a first nip pressure and to a second nip pressure, the first nip pressure and the second nip pressure being exerted at the nip when the first fixing member is in contact with the second fixing member, and the second nip pressure being smaller than the first nip pressure; and a controller configured to cause the first fixing member to heat up to a standby temperature lower than a fixing temperature, through a control process executed from a state in which rotation of the first fixing member is stopped and the nip pressure is set at the second nip pressure, the control process comprising:

a first process of activating and controlling the heater to cause the first fixing member to heat up toward a target temperature;

a second process of activating the motor, with the nip pressure at the second nip pressure, to start the rotation of the first fixing member and cause the second fixing member to rotate by friction with the first fixing member;

a third process of changing the nip pressure from the second nip pressure to the first nip pressure;

a fourth process of changing the nip pressure from the first nip pressure to the second nip pressure; and a fifth process of stopping the rotation of the first fixing member, wherein the first, second, third, fourth and fifth processes are executed in this sequence, and wherein the controller does not cause a sheet to be supplied between the first fixing member and the second fixing member while the first, second, third, fourth and fifth processes are being performed.

2. The image forming apparatus according to claim 1, wherein the controller is configured to activate the motor to start the rotation of the first fixing member in the second process when a temperature of the first fixing member has reached a first predetermined temperature.

3. The image forming apparatus according to claim 1, wherein the controller is configured to change the nip pressure from the second nip pressure to the first nip pressure in the third process at a time when a first predetermined period has elapsed from a time of starting the rotation of the first fixing member.

4. The image forming apparatus according to claim 1, wherein the controller is configured to change the nip pressure from the first nip pressure to the second nip pressure in the fourth process at a time when a second predetermined period has elapsed from a time of changing the nip pressure from the second nip pressure to the first nip pressure in the third process.

5. The image forming apparatus according to claim 1, wherein the controller is configured to stop the rotation of the first fixing member in the fifth process at a time when a third predetermined period has elapsed from a time of changing the nip pressure from the first nip pressure to the second nip pressure in the fourth process.

6. The image forming apparatus according to claim 1, wherein the controller is configured to:

change the target temperature if an initial temperature that is a temperature of the first fixing member as determined when the heater is activated in the first process is lower than a third predetermined temperature, in such a manner that the target temperature moves up stepwise toward the standby temperature, and set the target temperature at the standby temperature if the initial temperature is equal to or higher than the third predetermined temperature.

7. The image forming apparatus according to claim 1, wherein the second fixing member further includes:

an upstream pad, the belt being disposed between the upstream pad and the first fixing member; and a downstream pad located downstream relative to the upstream pad in a direction of conveyance of a sheet, the belt being disposed between the downstream pad and the first fixing member.

8. The image forming apparatus according to claim 7, wherein when the nip pressure is set at the first nip pressure, the belt is nipped between the upstream pad and the first fixing member and between the downstream pad and the first fixing member, and wherein when the nip pressure is set at the second nip pressure, the belt is nipped between the upstream pad and the first fixing member, and is not nipped between the downstream pad and the first fixing member.

9. An image forming apparatus, comprising:

a first fixing member including a roller;

a second fixing member including a belt configured to form a nip in combination with the first fixing member;

a heater configured to heat the first fixing member;

a pressure control mechanism configured to be capable of changing a nip pressure exerted at the nip formed between the first fixing member and the second fixing member, to a first nip pressure and to a second nip pressure smaller than the first nip pressure; and a controller configured to cause the first fixing member to heat up to a standby temperature lower than a fixing temperature, through a control process executed from a state in which rotation of the first fixing member is stopped and the nip pressure is set at the second nip pressure, the control process comprising:

a first process of activating and controlling the heater to cause the first fixing member to heat up toward a target temperature;

a second process of starting the rotation of the first fixing member;

a third process of changing the nip pressure from the second nip pressure to the first nip pressure;

a fourth process of changing the nip pressure from the first nip pressure to the second nip pressure; and a fifth process of stopping the rotation of the first fixing member, wherein the first, second, third, fourth and fifth processes are executed in this sequence, and wherein the controller is configured to change the nip pressure from the first nip pressure to the second nip pressure in the fourth process at a time when a temperature of the first fixing member has become equal to or higher than a second predetermined temperature that is lower than the standby temperature.

10. An image forming apparatus, comprising:

a fixing roller that receives a driving force from a motor;

a fixing belt configured to form a nip in combination with the fixing roller;

a heater configured to heat the fixing roller;

a pressure arm configured to provide a nip pressure exerted at the nip formed between the fixing roller and the fixing belt, the pressure arm being capable of providing a first nip pressure and a second nip pressure, the first nip pressure and the second nip pressure being exerted at the nip when the fixing roller is in contact with the fixing belt, and the second nip pressure being smaller than the first nip pressure; and a controller configured to cause the fixing roller to heat up to a standby temperature lower than a fixing temperature, through a control process executed from a state in which rotation of the fixing roller is stopped and the nip pressure is set at the second nip pressure, the control process comprising:

a first process of activating and controlling the heater to cause the fixing roller to heat up toward a target temperature;

a second process of activating the motor, with the nip pressure at the second nip pressure, to start the rotation of the fixing roller and cause the fixing belt to rotate by friction with the fixing roller;

a third process of changing the nip pressure from the second nip pressure to the first nip pressure;

a fourth process of changing the nip pressure from the first nip pressure to the second nip pressure; and a fifth process of stopping the rotation of the fixing roller, wherein the first, second, third, fourth and fifth processes are executed in this sequence and, wherein the controller does not cause a sheet to be supplied between the fixing roller and the fixing belt while the first, second, third, fourth and fifth processes are being performed.

11. The image forming apparatus according to claim 10, wherein the pressure arm provides the first nip pressure when the pressure arm is positioned in a first arm position, and the pressure arm provides the second nip pressure when the pressure arm is positioned in a second arm position different from the first arm position.

12. The image forming apparatus according to claim 11, further comprising a cam configured to change a position of the pressure arm to the first arm position and to the second arm position.

13. The image forming apparatus according to claim 10, wherein the controller is configured to activate the motor to start the rotation of the fixing roller in the second process when a temperature of the fixing roller has reached a first predetermined temperature.

14. The image forming apparatus according to claim 10, wherein the controller is configured to change the nip pressure from the second nip pressure to the first nip pressure in the third process at a time when a first predetermined period has elapsed from a time of starting the rotation of the fixing roller.

15. The image forming apparatus according to claim 10, wherein the controller is configured to change the nip pressure from the first nip pressure to the second nip pressure in the fourth process at a time when a second predetermined period has elapsed from a time of changing the nip pressure from the second nip pressure to the first nip pressure in the third process.

16. The image forming apparatus according to claim 10, wherein the controller is configured to change the nip pressure from the first nip pressure to the second nip pressure in the fourth process at a time when a temperature of the fixing roller has become equal to or higher than a second predetermined temperature that is lower than the standby temperature.

17. The image forming apparatus according to claim 10, wherein the controller is configured to stop the rotation of the fixing roller in the fifth process at a time when a third predetermined period has elapsed from a time of changing the nip pressure from the first nip pressure to the second nip pressure in the fourth process.

18. The image forming apparatus according to claim 10, wherein the controller is configured to:

change the target temperature if an initial temperature that is a temperature of the fixing roller as determined when the heater is activated in the first process is lower than a third predetermined temperature, in such a manner that the target temperature moves up stepwise toward the standby temperature, and set the target temperature at the standby temperature if the initial temperature is equal to or higher than the third predetermined temperature.

19. The image forming apparatus according to claim 10, further comprising:

an upstream pad, the fixing belt being disposed between the upstream pad and the fixing roller; and a downstream pad located downstream relative to the upstream pad in a direction of conveyance of a sheet, the fixing belt being disposed between the downstream pad and the fixing roller.

20. The image forming apparatus according to claim 19, wherein when the nip pressure is set at the first nip pressure, the fixing belt is nipped between the upstream pad and the fixing roller and between the downstream pad and the fixing roller, and wherein when the nip pressure is set at the second nip pressure, the fixing belt is nipped between the upstream pad and the fixing roller, and is not nipped between the downstream pad and the fixing roller.

* * * * *